US011125054B2

(12) United States Patent
Xie

(10) Patent No.: US 11,125,054 B2
(45) Date of Patent: Sep. 21, 2021

(54) HEATING AND ANTI-WAXING APPARATUS AND DEVICE FOR REDUCING VISCOSITY UNDER THE OIL WELL PUMP

(71) Applicant: Wei Xie, Surrey (CA)

(72) Inventor: Wei Xie, Surrey (CA)

( * ) Notice: Subject to any disclaimer, the term of this patent is extended or adjusted under 35 U.S.C. 154(b) by 12 days.

(21) Appl. No.: 16/594,051

(22) Filed: Oct. 6, 2019

(65) Prior Publication Data

US 2021/0102442 A1 Apr. 8, 2021

(51) Int. Cl.

| | |
|---|---|
| ***E21B 36/00*** | (2006.01) |
| ***E21B 36/04*** | (2006.01) |
| ***E21B 43/12*** | (2006.01) |
| *E21B 34/06* | (2006.01) |

(52) U.S. Cl.

CPC ..... *E21B 36/006* (2013.01); *E21B 36/04* (2013.01); *E21B 43/127* (2013.01); *E21B 43/128* (2013.01); *E21B 34/06* (2013.01); *E21B 2200/06* (2020.05)

(58) Field of Classification Search

CPC ..... E21B 36/006; E21B 36/04; E21B 43/127; E21B 43/128

See application file for complete search history.

(56) References Cited

U.S. PATENT DOCUMENTS 1,703,428 A * 2/1929 Neilsen ..... E21B 36/006 166/62
1,970,295 A * 8/1934 Fitzpatrick ..... E21B 43/2401 166/60
3,859,503 A * 1/1975 Palone ..... H05B 3/00 392/306
4,911,239 A * 3/1990 Winckler ..... E21B 17/1057 166/302
6,142,224 A * 11/2000 Stuebinger ..... E21B 41/0057 166/105.5
2002/0023751 A1* 2/2002 Neuroth ..... E21B 23/14 166/302

* cited by examiner

*Primary Examiner* — D. Andrews

(57) ABSTRACT

A device for heating oil and for reducing viscosity of the oil in an oil well is disclosed. The device comprises a pipe structure, a sucker rod, a three-way connector, a small pump cylinder, a small plunger, and a heating mechanism. The three-way connector is located below the pipe structure and has an upper end and two lower ends. The upper end of the three-way connector is connected to a bottom end of the pipe structure, and the two lower ends of the three-way connector comprises a first lower end which is coaxial with the oil pipe and a second lower end which is non-coaxial with the pipe structure. The first lower end of the three-way connector is connected to the small pump cylinder which is coaxial with the pipe structure. The second lower end of the three-way connector comprises a bypass port and a check valve. The sucker rod extends inside the pipe structure and extends through the upper end and the first lower end of the three-way connector and extends to a bottom end of the small pump cylinder. A bottom end of the sucker rod is provided with a small plunger, and the small plunger and the small pump cylinder constitute an axial sliding sealed fit. The heating mechanism extends along the sucker rod to the bottom end of the sucker rod to provide heating to crude oil in the oil well.

20 Claims, 6 Drawing Sheets

HEATING AND ANTI-WAXING APPARATUS AND DEVICE FOR REDUCING VISCOSITY UNDER THE OIL WELL PUMP

TECHNICAL FIELD

The present invention relates in general to a heating and anti-waxing apparatus and device for reducing the viscosity of oil under the oil well pump. The present invention is in the field of oil extraction devices and methods.

BACKGROUND

The extraction of petroleum is the process by which usable petroleum is drawn out from beneath the earth's surface location. Pumps, such as plunger pumps and electrical submersible pumps (ESPs), are often used to bring the oil to the surface.

In the development of oil fields, heavy oil, high-condensation oil, and/or high-wax oil wells often cause the pump efficiency to decrease, which affects the production of oil wells, and even the failure of the pump, which increases the cost of crude oil exploitation.

Therefore, it is desirable to provide apparatus and device which solve the problem that the existing oil production wells often encounter, namely, a decrease in pump efficiency in heavy oil, high-condensation oil and/or high-wax oil wells, which affects the production of oil wells, and even causes the failure of the pump and increases the cost of crude oil exploitation. It is desirable to provide safe and efficient methods and apparatus and devices which are applicable to plunger-type oil well pumps as well as electrical submersible pumps (ESPs) to reduce the viscosity of crude oil and to prevent waxing.

BRIEF DESCRIPTION OF DRAWINGS

In drawings which show non-limiting embodiments of the invention.

DETAILED DESCRIPTION

Figure 1:
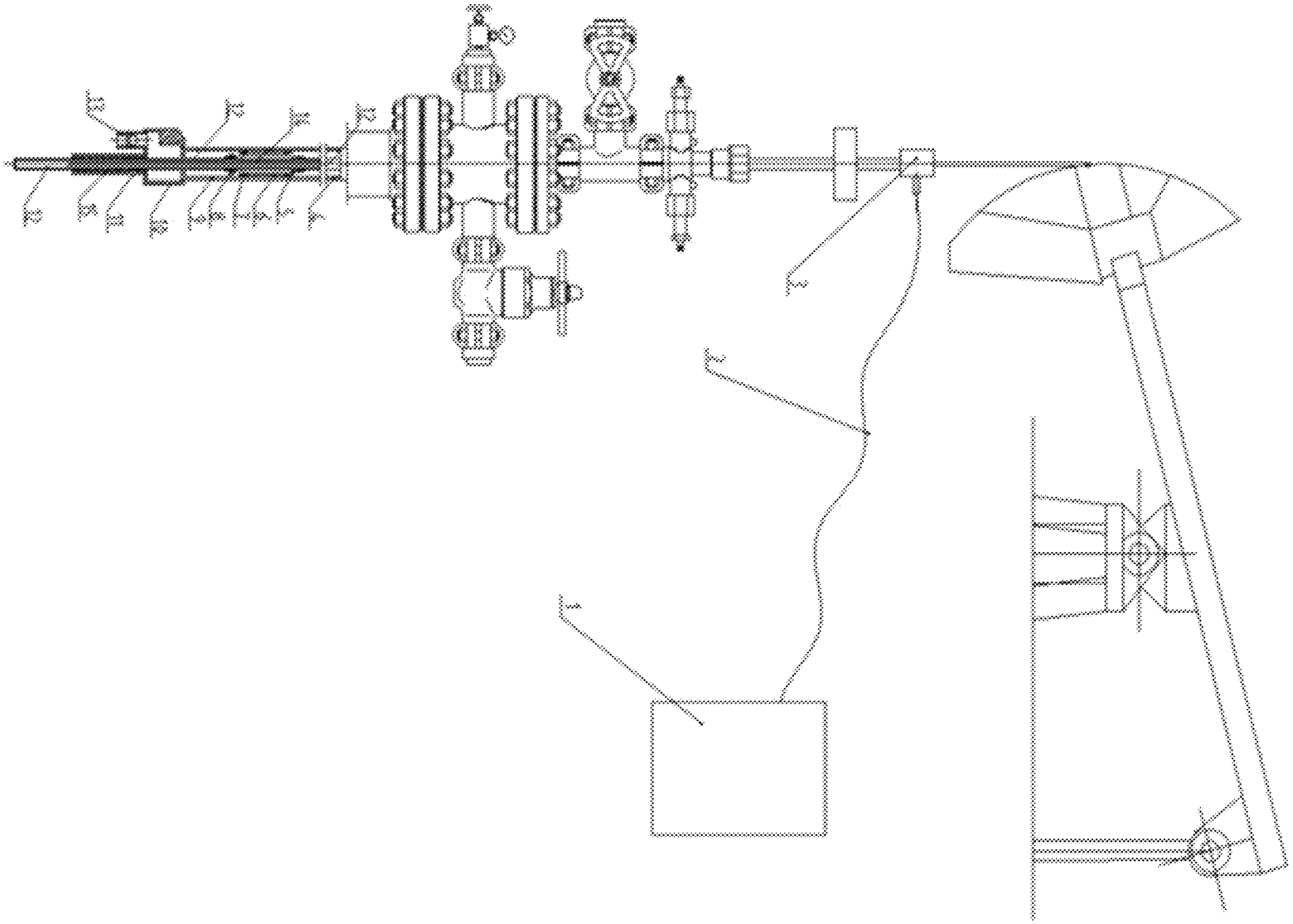
FIG. 1 is an overall structural view of an example embodiment of a heating and viscosity-lowering and anti-waxing device for an oil well pump of a plunger type oil pump.

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

A first aspect of the invention relates to an oil well pump heating and viscosity-reducing and anti-waxing device. The device comprises a plunger type oil pump (e.g., a reciprocating piston pump), a hollow sucker rod, a tubing (e.g., an oil pipe), a heating cable, a connecting cable, an electric controller, and a three-way connector. The plunger type oil pump is connected at the bottom of the tubing, and the three-way connector is connected at the bottom end of a pump barrel which houses the plunger type oil pump. The tubing and the pump barrel together form an extended pipe formation, and the tubing and the pump barrel are co-axial. Generally, the pump barrel has a smooth interior surface. The interior surface of the tubing does not need to be smooth. The three-way connector has a hollow interior which is in fluid commincation with the interior of the pump barrel. The three-way connector has two lower ends, the first lower end being coaxial with the tubing (and the pump barrel), and the second lower end being non-coaxial with the tubing (i.e., being offset from the tubing). The coaxial lower end of the three-way connector is connected to a small pump cylinder (e.g., a small pump barrel which has a smaller diameter compared to the pump barrel). The small pump cylinder is coaxial with the tubing. At the non-coaxial lower end of the three-way connector, a bypass port of the three-way connector is provided with a one-way valve (also known as a check valve or stationery valve). The one-way valve is capable of allowing crude oil outside of the valve to enter the hollow interior of the three-way connector, but the other way around.

The plunger of the plunger type oil pump is located inside the pump barrel and above the three-way connector. The plunger of the plunger type oil pump includes a plunger upper joint and a plunger barrel, and a sliding valve seat. The plunger barrel and the pump barrel form an axial sliding sealing fit. The plunger upper joint is fixedly connected to the upper end of the plunger barrel. The plunger upper joint is conical, and the conical upper part of the plunger upper joint and the hollow sucker rod constitute an axial sliding sealing fit. The conical cone surface of the plunger upper joint is provided with one or more diversion or oil discharge holes in the circumferential direction. The sliding valve seat is annular. The sliding valve seat is connected to the bottom of the plunger barrel. The sliding valve sleeve is fixedly connected to the hollow sucker rod. The sliding valve sleeve and the sliding valve seat can form a sealing fit. The sliding valve sleeve and the sliding valve seat can move from closed position to open position and vice versa. The heating cable extends along the hollow sucker rod to the bottom of the hollow sucker rod. The top of the sucker rod is provided with a cable inlet. One end of the connecting cable is connected to the heating cable, and the other end of the connecting cable is connected to the electric controller. Depending on the depth of the oil well, the heating cable may have a length of 500 to 2000 meters or more. The heating cable may comprise a heating element core (for example, a copper core). Heat is generated when electric current is passed through the core which has a resistance to electric current.

The bypass port of the three-way connector has an "L" shape; the opening direction is downward; the one-way valve is disposed at the opening which is non-coaxial with the tubing; the coaxial lower end of the hollow sucker rod is provided with a small plunger, and the small plunger and the small pump cylinder constitute an axial sliding sealed fit.

In some embodiments, the valve sleeve and the valve seat have a tapered surface. The electric controller may be a variable frequency controller.

A second aspect of the invention relates to an oil well pump heating and viscosity reducing and anti-waxing device. The device comprises a plunger type oil pump, a hollow sucker rod, a tubing, a heating circulation device, and a three-way connector which is connected to the bottom of a pump barrel which is connected to the bottom end of the tubing. The three-way connector has two lower ends, the first lower end being coaxial with the tubing, and the second lower end being non-coaxial with the tubing (i.e., being offset from the tubing). The coaxial lower end of the three-way connector is connected to a small pump cylinder. The small pump cylinder is coaxial with the tubing. At the non-coaxial lower end of the three-way connector, a bypass port of the three-way connector is provided with a one-way valve (also known as a check valve).

The plunger of the plunger type oil pump includes a plunger upper joint and a plunger barrel, a sliding valve seat. The plunger barrel and the pump barrel form an axial sliding sealing fit, and the plunger upper joint is fixedly connected to the upper end of the plunger barrel. The plunger upper joint is conical, and the conical upper part and the hollow sucker rod constitute an axial sliding sealing fit. The conical cone surface is provided with one or more diversion or oil discharge holes in the circumferential direction. The sliding valve seat is annular. The sliding valve seat is connected to the bottom of the plunger barrel. The sliding valve sleeve is fixedly connected to the hollow sucker rod, and the sliding valve sleeve and the sliding valve seat can form a sealing fit, when they are closed.

The hollow sucker rod is a double-channel hollow sucker rod composed of an outer tube and an inner tube, and the bottom of the outer tube is blocked, and there is a first connection connecting the inner tube and there is a second connection connecting the space between the inner and outer tubes arranged on the top of the double-channel hollow sucker rod. The heating circulation device comprises a medium heating furnace for heating a medium (e.g., water), a circulation pump, and a controller. The circulation pump is connected between the medium heating furnace and the two-channel hollow sucker rod. The controller is connected to control the temperature of the heating medium of the medium heating furnace and the circulation pump flow rate.

The bypass port of the three-way connector has an "L" shape; the opening direction is downward; the one-way valve is disposed at the opening. The lower end of the hollow sucker rod is provided with a small plunger, and the small plunger and the small pump cylinder constitute an axial sliding sealed fit. The sliding valve sleeve and the sliding valve seat have a tapered surface.

A third aspect of the invention relates to an oil well pump heating and viscosity reducing and anti-waxing device. The device comprises a plunger type oil pump, a hollow sucker rod, a tubing, a heating circulation device, a three-way connector which is connected to the bottom of a pump barrel which is connected to the bottom end of the tubing. The three-way connector has two lower ends, the first lower end being coaxial with the tubing, and the second lower end being non-coaxial with the tubing (i.e., being offset from the tubing). The coaxial lower end of the three-way connector is connected to a small pump cylinder. The small pump cylinder is coaxial with the tubing. At the non-coaxial lower end of the three-way connector, a bypass port of the three-way connector is provided with a one-way valve (also known as a check valve).

The plunger of the plunger type oil pump includes a plunger upper joint, a plunger cylinder, and a sliding valve seat. The plunger barrel and the pump barrel (or the tubing) form an axial sliding sealing fit. The pump barrel is connected (e.g., threadedly connected) to the tubing and may be considered to be an extension of the tubing. The plunger upper joint is fixedly connected to the upper end of the plunger barrel. The plunger upper joint is conical, and the conical upper part and the hollow sucker rod constitute an axial sliding sealing fit. On the conical cone surface are one or more holes or openings arranged in the circumferential direction. The sliding valve seat is annular. The sliding valve seat is connected to the bottom of the plunger barrel. The sliding valve sleeve is fixedly connected to the hollow sucker rod, and the sliding valve sleeve and the sliding valve seat can form a seal. The bottom of the hollow sucker rod is open, and the top is provided with an interface communicating with the interior of the hollow sucker rod. The heating circulation device comprises a medium heating furnace (for heating a medium such as water), a circulation pump, and a controller. The circulation pump is connected between the medium heating furnace and the hollow sucker rod. The controller is connected to the furnace for heating and temperature control and is also connected to the medium circulation pump to control the pump flow rate.

The bypass port of the three-way joint has an L shape; the opening direction is downward; the one-way valve is disposed at the opening. The lower end of the hollow sucker rod is provided with a small plunger, and the small plunger and the small pump cylinder constitute an axial sliding sealed fit. The valve sleeve and the valve seat have a tapered surface.

A fourth aspect of the invention relates to an oil well pump heating and viscosity reducing and anti-waxing device. The device comprises an electric submersible pump (ESP), a hollow sucker rod, a tubing, a hollow sucker rod heating device, and a ground heating controller. A three-way connector is connected at a bottom end of the tubing. The three-way connector has two lower ends, the first lower end being coaxial with the tubing, and the second lower end being non-coaxial with the tubing (i.e., being offset from the tubing). The coaxial lower end of the three-way connector is connected to a small pump cylinder. The small pump cylinder is coaxial with the tubing. At the non-coaxial lower end of the three-way connector, a bypass port of the three-way connector is provided with a one-way valve (also known as a check valve).

The electric submersible pump is disposed at a bypass port of the three-way connector, and a check valve is disposed below the electric submersible pump at the bypass port. The hollow sucker rod heating device is disposed in the hollow sucker rod, and at the top of the hollow sucker rod is provided with an interface between the hollow sucker rod heating device and the ground heating controller.

The bypass port of the three-way joint has an L shape; the opening direction is downward; the electric submersible pump and the check valve are disposed at a downward opening. A small plunger is disposed at a lower end of the hollow sucker rod. The small plunger and the small pump cylinder form an axial sliding seal fit.

The hollow sucker rod heating device is divided into three types. The first type is a heating cable. The ground heating controller matched with it is an electric controller. The electric controller may be a variable frequency controller.

The second type is the bottom opening of the hollow sucker rod, and the inside is the heating medium passage. The ground heating controller comprises the medium heating furnace, the circulating pump, and the controller. The circulation pump is connected between the medium heating furnace and the hollow sucker rod. The controller is connected to the furnace for heating and temperature control and is also connected to the medium circulation pump to control the pump flow rate.

The third type of the hollow sucker rod heating device adopts a double-channel hollow sucker rod composed of an outer tube and an inner tube, and the bottom of the outer tube is sealed, and the inside is a heating medium along the inner tube and the annular gap passage between the inner and outer tube. The top of the two-channel hollow sucker rod is respectively provided with an interface connected with the inner tube and an interface connected with the annular gap between the inner and outer tube. The heating circulation device comprises a medium heating furnace and a circulation pump, and a controller. The circulation pump is connected between the medium heating furnace and the two-channel hollow sucker rod. The controller connects and controls the medium heating furnace heating temperature and circulation pump flow.

The invention as described herein provides a number of different technical solutions and advantages by adding a three-way connector and a small pump cylinder structure at the bottom of the oil pipe (or tubing), by means of cable heating or medium heating, and by providing oil pumping methods for both the plunger type oil pump and the electric submersible pump (ESP). The heavy oil, high-condensation oil and high-wax oil around the bottom of the tubing (including the crude oil below the three-way connector and outside of the one-way valve) are quickly heated and reduced in viscosity, which solves the problems of pump failure, increases the efficiency of crude oil extraction, and avoids safety accidents such as electric leakage.

Because the sucker rod extends to a position below the three-way connector, the heating mechanism (heating cable or heating medium) also extends to a position below the three-way connector. Therefore, the device can heat the crude oil that is outside of the one-way valve before the crude oil even enters the three-way connector. This is a significant advantage, as the device enables crude oil both inside the device and outside the device to be heated. In some embodiments, the device can heat the crude oil to a temperature range of at least 50 to 80 degrees Celsius. If the crude oil has a tendency to form wax, wax formation is usually prevented when the crude oil is heated to above 50 degrees Celsius. If the crude oil is viscous, heating to a temperature range of 50 to 80 degrees Celsius can reduce the viscosity of the crude oil. The device can heat the crude oil outside the system to a desired temperature range before the crude oil enters the three-way connector via the one-way valve. The device can also heat the crude oil that has already entered the device, including the crude oil in the tubing going all the way up to the ground surface.

Figure 2:
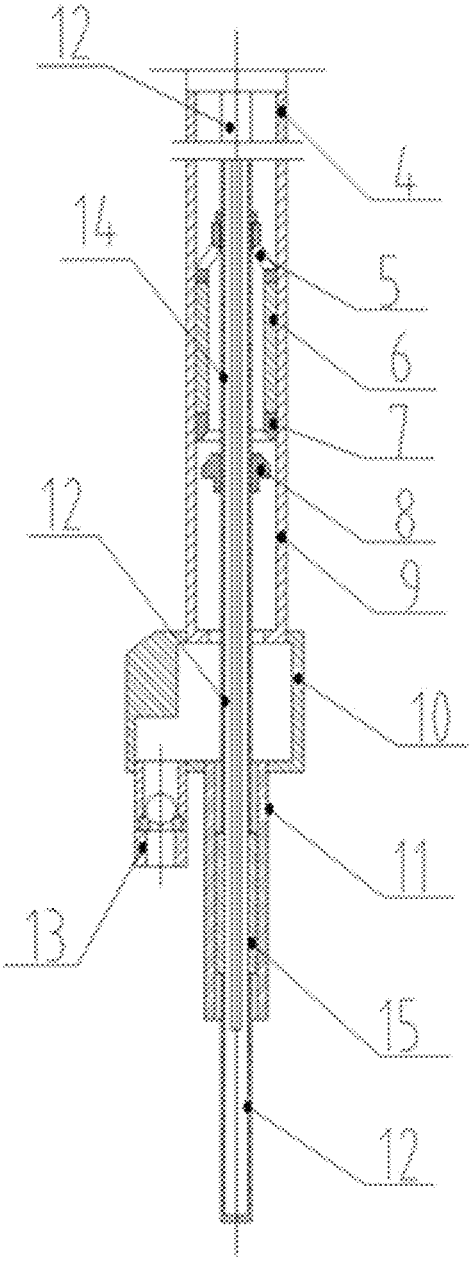
FIG. 2 is a partial enlarged structural view of FIG. 1.
Figure 3:
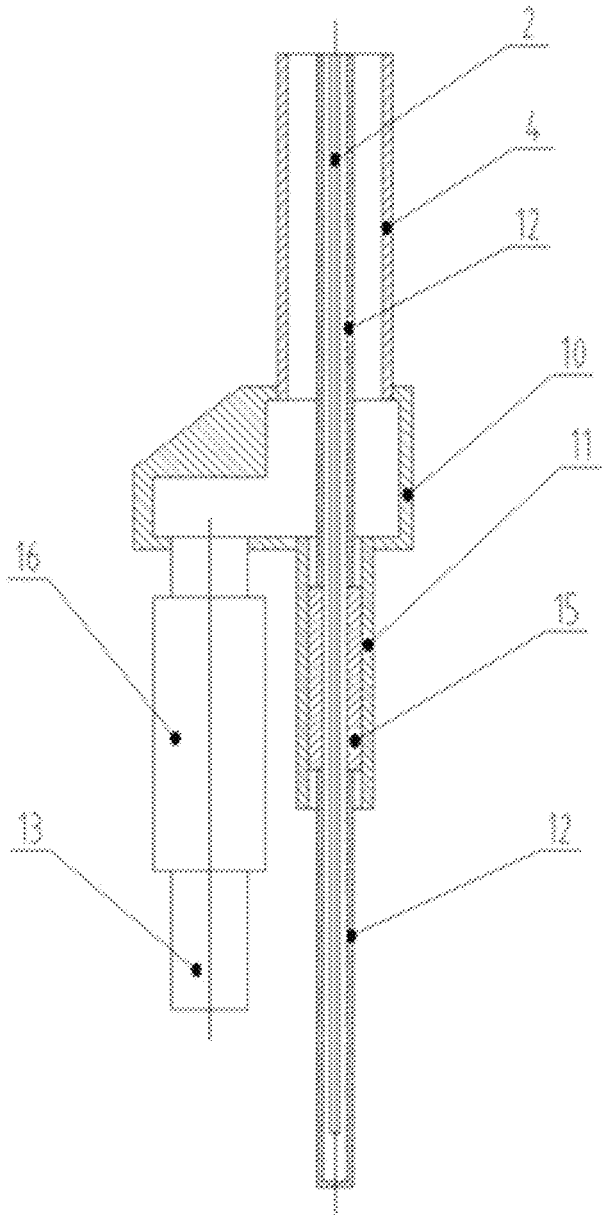
FIG. 3 is a partial enlarged structural view showing another embodiment wherein the oil pump is an electrical submersible pump (ESP), instead of plunger type oil pump.

FIG. 1 is an overall structural view of an example embodiment of a heating and viscosity-lowering and anti-waxing device for an oil well pump of a plunger type oil pump. FIG. 2 is a partial enlarged structural view of FIG. 1. FIG. 3 is a partial enlarged structural view showing another embodiment wherein the oil pump is an electric submersible pump, instead of plunger type oil pump. In these Figures, the reference numbers are as follows: 1 electric controller (or heating circulation device), 2 heating cable (or connecting cable, heating pipeline), 3 interface (or inlet), 4 oil pipe (or tubing), 5 plunger upper joint, 6 plunger barrel, 7 sliding valve seat, 8 sliding valve sleeve, 9 pump barrel (or tubing), 10 three-way connector, 11 small pump cylinder, 12 hollow sucker rod, 13 check valve, 14 center tube (or hollow sucker rod), 15 small plunger, 16 electric submersible pump (ESP). The center tube is very similar structurally to the sucker rod and is connected at the top and at the bottom to sucker rods. The center tube can be considered a specialized type of sucker rod.

The invention will be further described below in conjunction with the drawings and specific embodiments. Referring to FIGS. 1 and 2, an embodiment of a heating and viscosity-lowering and anti-waxing device for a well pump of a plunger type oil pump is disclosed. The device comprises a plunger type oil pump, a hollow sucker rod 12, an oil pipe 4, a heating cable, a connecting cable 2 and an electric controller 1. A three-way connector 10 is connected to a pump barrel 9 which is at the bottom end of the oil pipe 4. The three-way connector 10 has two lower ends, the first lower end being coaxial with the oil pipe 4, and the second lower end being non-coaxial with the oil pipe (i.e., being offset from the oil pipe). The coaxial lower end of the three-way connector 10 is connected to the small pump cylinder 11. The small pump cylinder 11 is kept coaxial with the oil pipe 4, and the bypass port of the three-way connector 10 is provided with a check valve 13. The plunger of the plunger pump includes a plunger upper joint 5 and a plunger barrel 6, and a sliding valve seat 7. The plunger barrel 6 and the oil pipe 4 form an axial sliding sealing fit. The plunger upper joint 5 is fixedly connected to the upper end of the plunger barrel 6. The plunger upper joint 5 has a conical shape, and the conical upper portion and the hollow sucker rod 12 constitute an axial sliding sealing fit. The conical tapered surface is provided with one or more flow holes or openings in the circumferential direction. The sliding valve seat 7 is annular, and the sliding valve seat 7 is connected to the bottom of the plunger barrel 6. A valve sleeve 8 is fixedly connected to the hollow sucker rod 12, and the valve sleeve 8 and the valve seat 7 can form a sealing fit along the axial stroke. The heating cable 2 extends along the interior of the hollow sucker rod 12 to the bottom of the hollow sucker rod. A cable access port 3 is provided at the top of the hollow sucker rod 12. One end of the connecting cable 2 is connected to the heating cable 2, and the other end of the connecting cable 2 is connected to the electric controller 1.

The bypass port of the three-way joint 10 has an L shape; the opening direction is downward; and the check valve 13 is disposed at the opening. A small plunger 15 is arranged at the lower end of the hollow sucker rod, and the small plunger 15 forms an axial sliding sealing fit with the small pump cylinder 11 (to prevent the underground crude oil from entering the small pump cylinder 11). The sealing valve sleeve 8 and the swimming valve seat 7 have a sealing surface which is tapered. The electric controller 1 may be a variable frequency controller.

This embodiment employs an electric heating method for a plunger or piston type pump. The method heats the hollow sucker rod via the heating cable, which indirectly heats the oil (e.g., the heavy oil, high viscosity oil and/or high wax oil) in the space between hollow sucker rod and tubing as well as between tubing and casing. Because the heating cable extends to the bottom of the sucker rod, the heating cable can also heat the crude oil outside of the system below the three-way connector before the crude oil enters the system via check valve 3.

Referring to FIGS. 1 and 2, the cable 2 is routed from the interface 3 down to the bottom of the hollow sucker rod 12. The lower end of the interface 3 is connected to the hollow sucker rod 12; the hollow sucker rod 12 is connected to the upper end of the center tube 14, and the lower end of the center tube 14 is also connected to the hollow sucker rod 12 until the lower portion of the small pump cylinder 11. A plunger upper joint 5 is mounted on the upper portion of the plunger barrel 6. An oil discharge passage is provided on the plunger upper joint 5, and a valve seat 7 is mounted on the lower portion of the plunger barrel. The center tube 14 passes through the plunger barrel 6, and the center tube 14 and the plunger barrel 6 form an annulus flow passage. The plunger barrel 6 can slide up and down on the center tube, and the center tube 14 is provided with a sliding valve sleeve 8. The valve sleeve 8 is located below the plunger barrel 6, and the valve seat 7 can form a sealing fit with the sliding valve sleeve 8.

The lower end of the oil pipe 4 is connected to the pump barrel 9, and inside the pump barrel 9 is a plunger 6. The lower end of the pump barrel 9 is connected with the three-way connector 10, and the first lower end of the three-way connector 10 which is coaxial with the pump barrel 9 is connected to the small pump cylinder 11. The second lower end of the three-way joint 10 is provided with a one-way valve, e.g., check valve 13.

When the hollow sucker rod 12 descends, the hollow sucker rod 12 initially drives the plunger 6 down, and the check valve 13 closes. During the downward movement, the valve seat 7 on the plunger barrel 6 is separated from the valve sleeve 8 on the center tube 14. The crude oil enters the upper portion of pump barrel 9 above the plunger 6 through the oil discharge passage holes of the plunger upper joint 5. When the hollow sucker rod 12 ascends, the valve seat 7 on the plunger barrel 6 and the valve sleeve 8 on the center tube 14 form a seal and are closed. Crude oil drains from tubing 4 to the surface pipeline. At the same time, the one-way valve 13 is opened, and the crude oil in the oil well flows into the pump cylinder 9 through valve 13. This cycle of reciprocating motion achieves crude oil lifting.

Referring to FIGS. 1 and 2, another embodiment of a heating and viscosity-lowering and anti-waxing device for a well pump of a plunger type oil pump is disclosed. The device comprises a plunger type oil pump, a hollow sucker rod 12, an oil pipe 4, a heating circulation device 1, and a three-way connector 10 which is connected at a bottom end of the oil pipe 4. A small pump cylinder 11 is connected to a lower end of the three-way connector 10. The small pump cylinder 11 and the oil pipe 4 are kept coaxial. The bypass port of the three-way connector 10 is provided with a one-way valve 13. The plunger of the plunger type oil pump includes a plunger upper joint 5 and a plunger barrel 6, and a valve seat 7. The plunger upper joint 5 is fixedly connected to the upper end of the plunger barrel 6. The plunger upper joint 5 has a conical shape. The conical upper portion of the plunger upper joint 5 forms an axial sliding sealing fit with the hollow sucker rod 12 or the center tube 14. The conical cone surface is provided with one or more fluid discharge holes in the circumferential direction. The valve seat 7 is annular, and the valve seat 7 is connected to the bottom of the plunger barrel 6. A valve sleeve 8 is fixedly connected to the hollow sucker rod 12, and the valve sleeve 8 and the valve seat 7 can form a sealing fit. The hollow sucker rod 12 is a double-channel hollow sucker rod composed of an outer tube and an inner tube, and the bottom of the outer tube is blocked, and an interface 3 connected to the inner tube and an interface 3 connected to a space between the inner and outer tube are respectively arranged on the top of the double-channel hollow sucker rod. The heating circulation device 1 comprises a medium heating furnace and a circulation pump, and a controller. The circulation pump is connected between the medium heating furnace and the two-channel hollow sucker rod, and the controller connects and controls the medium heating furnace (to control heating temperature) and the circulating pump (to control flow rate).

The bypass port of the three-way joint 10 is L-shaped, the opening direction is downward, and a small plunger 15 is arranged at the lower end of the hollow sucker rod, and the small plunger 15 and the small pump cylinder 11 form an axial sliding seal fit, and the check valve 13 is placed at the opening. The valve sleeve 8 and the valve seat 7 have a sealing surface which is tapered.

This embodiment employs a heat medium heating method for the plunger type oil pump. The heating medium is returned to the ground heating circulation device through the inner tube and the outer tube of the double channel hollow sucker rod, and the outer tube of the hollow sucker rod is heated to indirectly heat the crude oil (e.g., the heavy oil, high-condensation oil and high-wax oil) between the sucker rod and the oil pipe, and between the oil pipe and the casing, and the crude oil outside the system in the oil well before the crude oil enters check valve 13. The heating method can recycle the heating medium (e.g., heated water) and is suitable for heavy oil wells with low viscosity.

Referring to FIGS. 1 and 2, another embodiment of a heating and viscosity-lowering and anti-waxing device for a well pump of a plunger type oil pump is disclosed. The device comprises a plunger type oil pump, a hollow sucker rod 12, an oil pipe 4 and a heating circulation device 1, and a three-way joint 10 which is connected at a bottom end of the oil pipe, a lower end of the three-way joint 10 is connected to the small pump cylinder 11, and the small pump cylinder 11 and the oil pipe 4 are kept coaxial. The bypass port of the three-way joint 10 is provided with a one-way valve 13. The plunger of the plunger type oil pump includes a plunger upper joint 5 and a plunger barrel 6, a valve seat 7. The plunger barrel 6 and the oil pipe 4 constitute an axial sliding seal fit. The plunger upper joint 5 is fixedly connected to the upper end of the plunger barrel 6. The conical upper portion and the hollow sucker rod 12 form an axial sliding sealing fit, and the conical tapered surface is provided with one or more fluid discharge holes in the circumferential direction. The valve seat 7 is annular, and the valve seat 7 is connected to the bottom of the plunger barrel 6; a valve sleeve 8 is fixedly connected to the hollow sucker rod 12, and the valve sleeve 8 and the valve seat 7 can form a sealing fit. The hollow sucker rod 12 is open at the bottom, and the top is provided with an interface 3 communicating with the inside of the hollow sucker rod. The heating circulation device 1 comprises a medium heating furnace and a circulation pump, a controller, and the circulation pump is connected to the medium heating furnace and the hollow sucker rod. The controller connects and controls the media furnace heating temperature and circulating pump flow.

The bypass port of the three-way joint 10 has an L shape, the opening direction is downward, the check valve 13 is disposed at the opening, and the small plunger 15 is disposed at the lower end of the hollow sucker rod, and the small plunger 15 and the small pump cylinder 11 form an axial sliding seal fit. The valve sleeve 8 and the valve seat 7 have a sealing surface which is tapered.

This embodiment employs a heat medium heating method for the plunger type pumping pump. The heating medium directly enters the downhole oil pipe through the single-channel hollow sucker rod, and heats the hollow sucker rod and the oil (e.g., heavy oil, high-condensation oil and high-wax oil) between the sucker rod and the oil pipe, and between the oil pipe and the casing, and the crude oil below the three-way connector 10 in the oil well before the crude oil enters check valve 13. This heating method is suitable for high viscosity heavy oil, high condensation oil and high waxy oil wells.

Referring to FIG. 3, an embodiment of a heating, viscosity reducing and anti-waxing device for an oil well pump of an electric submersible pump is disclosed. The device comprises an electric submersible pumping pump 15, a hollow sucker rod 12, a tubing 4, a hollow sucker rod heating device and a ground heating controller. A three-way joint 10 is connected to the bottom end of the oil pipe 4, the lower end of the three-way joint 10 is connected to the small pump cylinder 11, the small pump cylinder 11 is kept coaxial with the oil pipe 4, and the electric submersible oil pump 15 is disposed at the bypass port of the three-way joint 10, and a check valve 13 is provided at the bypass port.

The hollow sucker rod heating device is disposed in the hollow sucker rod 12, and an interface 3 for connecting the hollow sucker rod heating device to the ground heating controller is disposed on the top of the hollow sucker rod 12.

The bypass port of the three-way joint 10 has an L shape, the opening direction is downward, the electric submersible pump 15 and the check valve 13 are disposed at the downward opening, and the small plunger 15 is provided at the lower end of the hollow sucker rod. The plunger 15 forms an axial sliding sealing fit with the small pump barrel 11.

The hollow sucker rod heating device has three heating modes. In one mode, the hollow sucker rod heating device is a heating cable, and the ground heating controller matched with it is an electric controller 1. The electric controller 1 is preferably a variable frequency controller.

In this embodiment, the device comprises an electric submersible pump (ESP). The heating cable 2 is kept from the interface 3 down to the bottom of the hollow sucker rod 12. The lower end of the interface 3 is connected to the hollow sucker rod 12, and the hollow sucker rod 12 reaches the bottom of the small pump barrel 11. The lower end of the oil pipe 4 is connected to the three-way joint 10, and the lower portion of the three-way joint 10 of the coaxial line of the oil pipe is connected to the small pump cylinder 11. The other interface of the Y-shaped joint 10 is equipped with a submersible electric pump 15, and the submersible electric pump 15 is connected to the check valve 13 at the lower end.

The second heating mode is heating medium heating. The bottom of the hollow sucker rod 12 may be open (that is not closed), and the inside is a heating medium guiding passage, and the ground heating controller cooperates with the medium heating furnace and the circulating pump, and the controller. The circulation pump is connected between the medium heating furnace and the hollow sucker rod, and the controller connects and controls the medium heating furnace heating temperature and the circulating pump flow rate.

The third heating mode adopts a double-channel hollow sucker rod composed of an outer tube and an inner tube, and the bottom of the outer tube is sealed, and the inside is a heating medium along the inner tube and the inner and outer tube annular gap guiding passage. The top of the two-channel hollow sucker rod is respectively provided with a first interface connected with the inner tube and a second interface connected with the annular gap space between the inner and outer tubes. The heating circulation device comprises a medium heating furnace and a circulation pump, a controller, and the circulation pump is connected between the medium heating the furnace and the two-channel hollow sucker rod. The controller connects and controls the medium heating furnace heating temperature and circulation pump flow.

Figure 4:
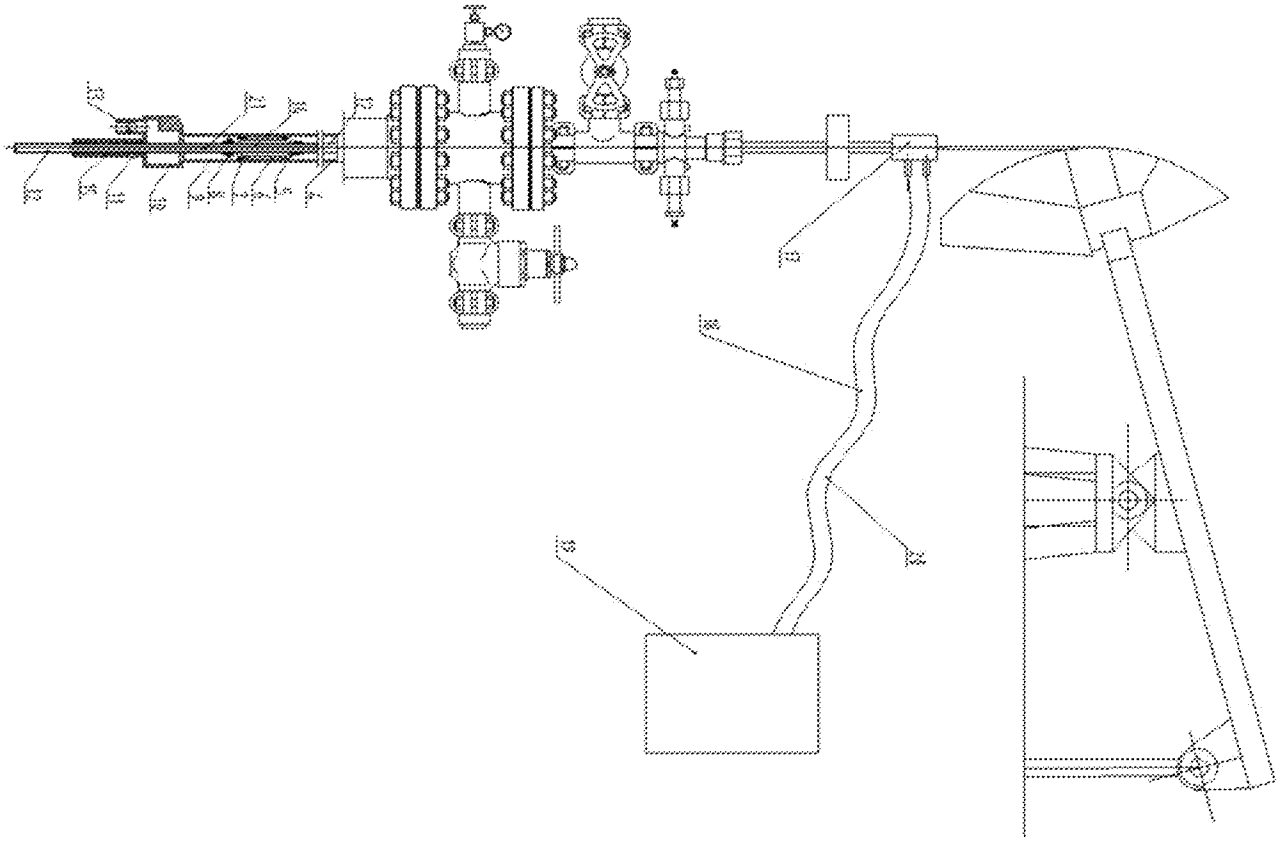
FIG. 4 is an overall structural view of another example embodiment of a heating and viscosity-lowering and anti-waxing device for an oil well pump of a plunger type oil pump.
Figure 5:
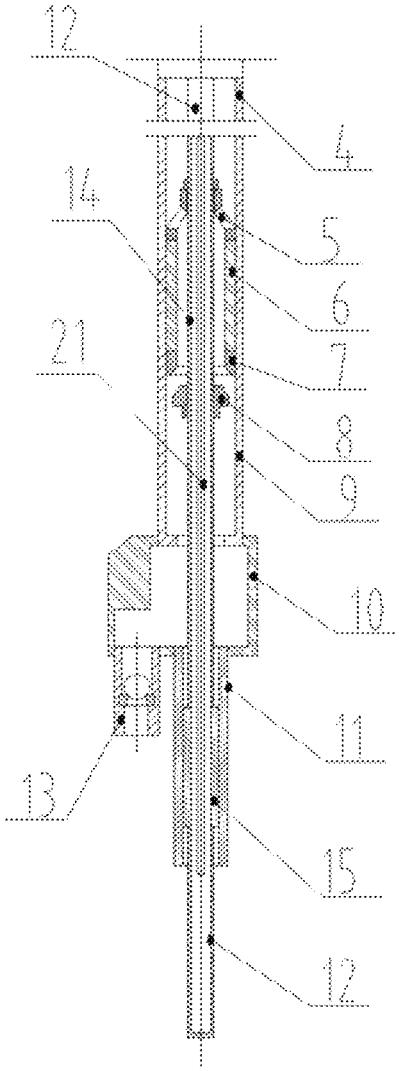
FIG. 5 is a partial enlarged structural view of FIG. 4.

As shown in FIG. 4 and FIG. 5, a closed circuit heating process and device of the heat medium under the pumping well pump is disclosed. In these Figures, the reference numbers are as follows: a heater 19, a medium injection pipe 20, a medium return pipe 18, a four-way connection 17, an oil pipe 4, an upper joint 5, and a plunger barrel 6, valve seat 7, valve sleeve 8, pump barrel 9, Y-shaped three-way joint 10, small pump cylinder 11, hollow sucker rod 12, one-way valve 13, center tube 14, small plunger 15, heat-insulating inner tube 21.

Figure 6:
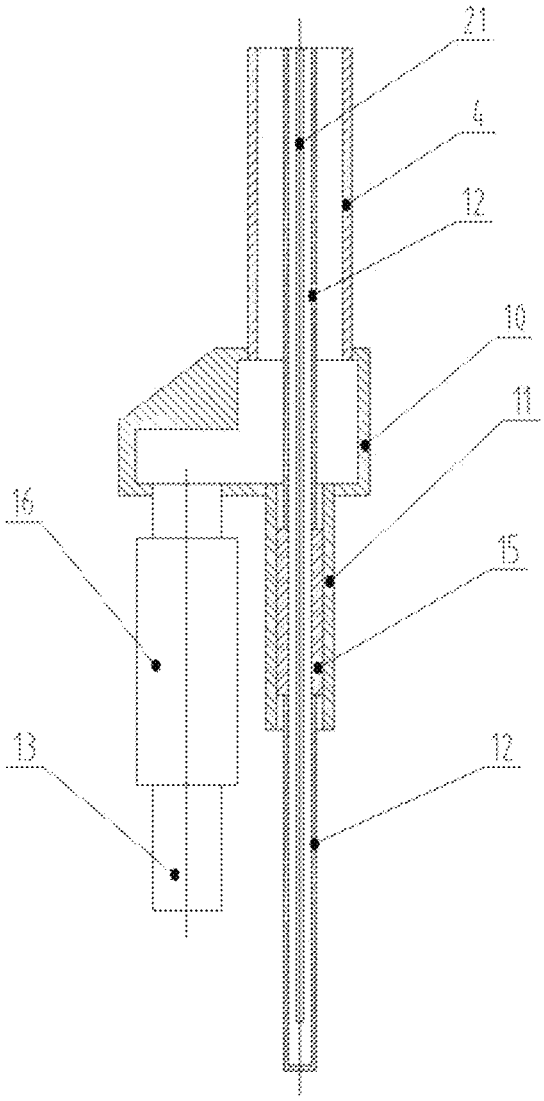
FIG. 6 is a partial enlarged structural view showing another embodiment wherein the oil pump is an electrical submersible pump (ESP), instead of plunger type oil pump.

As shown in FIG. 4 and FIG. 6, a device and process of heat medium heating with closed circulation heating and the submersible electric pump well pump is disclosed. In these Figures, the reference numbers are as follows: heater 19, the medium injection pipe 20, the medium return pipe 18, the four-way connection 17, the oil pipe 4, and the hollow sucker rod 12, The Y-shaped three-way joint 10, the small pump cylinder 11, one-way valve 13, the small plunger 15, the submersible electric pump 16, and the heat-insulating inner tube 21.

With reference to FIGS. 4 and 5, the heater 19 heats the medium (e.g., water), and uses a circulation pump to transfer the heat medium from the medium injection pipe 20 through the four-way connection 17 and the heat-insulating inner tube 21 to the bottom of the hollow sucker rod 12, and then is returned to the heater 19 via the gap space between the inner tube 21 and the sucker rod 12 to form a closed loop. The lower end of the four-way connection 17 is connected to the hollow sucker rod 12, and the hollow sucker rod 12 is connected to the upper end of the center tube 14, and the lower end of the center tube 14 is connected to the small plunger 15, and the lower end of the small plunger 15 is connected to the hollow sucker rod 12. The upper part of the plunger 6 is provided with an upper joint 5, and the upper joint 5 is provided with an oil discharge passage, and the lower part of the plunger 6 is provided with a movable valve seat 7. The center tube 14 passes through the plunger 6, and the center tube 14 and the plunger 6 form an annulus flow passage, and the plunger 6 can slide up and down on the center tube, the center tube 14 is mounted with a valve sleeve 8, and the valve sleeve 8 is located at the lower part of the plunger 6. The valve seat 7 forms a sealing fit with the valve sleeve 8. The lower end of the oil pipe 4 is connected to the pump barrel 9, and the pump barrel 9 has a plunger 6, and the lower end of the pump barrel 9 is connected with the Y-shaped three-way joint 10, and the lower part of the Y-shaped three-way joint 10 coaxial with the pump barrel 9 is connected with the small pump cylinder 11. In the small pump cylinder 11 there is a small plunger 15 inside. The small plunger 15 is connected to the hollow sucker rod 12. When sucker rod 12 moves up and down, small plunger 15 also moves up and down. The small pump cylinder 11 forms a sealing fit with the small plunger 15. The other interface of the Y-shaped three-way joint 10 is mounted with a one-way valve 13.

When the heating medium returns through the space between the hollow sucker rod 12 and the heat insulating inner tube 21, the crude oil in the oil pipe, the pump cylinder barrel 9, inside the three-way connector 10 and in the pump downhole well below the three-way connector 10 are heated, and the viscosity of the crude oil in the heavy oil well is lowered, the flow is accelerated, and the flow is increased. Pump efficiency is increased. Waxing of the oil pump or the oil pipe is also blocked.

When the hollow sucker rod 12 descends, the valve seat 7 on the plunger 6 is separated from the valve sleeve 8 on the center tube 14, and at the same time, the hollow sucker rod 12 drives the plunger 6 and the small plunger 15 to descend. The one-way valve 13 is closed. Due to the volume difference between the pump barrel 9 and the small pump cylinder 11, the crude oil enters the upper portion of the pump barrel 9 above the plunger 6 through the space of the plunger 6 and the center pipe 14 via the oil discharge passage of the upper joint 5. When the hollow sucker rod 12 ascends, the valve seat 7 on the plunger 6 and the valve sleeve 8 on the center tube 14 are closed, and the crude oil is discharged from the oil pipe 4 to the surface line. At the same time, the one-way valve 13 is opened, and the crude oil in the oil well flows into the pump barrel 9. This way, the series of reciprocating motions realize the crude oil lifting.

With reference to FIGS. 4 and 6, wherein FIG. 6 shows an electric submersible pump well production, the heater 19 heats the medium, and uses a circulation pump to bring the heating medium via the medium injection pipe 20 through the four-way connection 17 and the heat-insulating inner tube 21 to the bottom of the hollow sucker rod 12, and then via the space between the hollow sucker rod 12 and the inner tube 21, the heating medium is returned to the ground medium return pipe 18 to the heater 19 to form a closed loop. The lower end of the four-way connection 17 is connected to the hollow sucker rod 12, and the bottom end of the hollow sucker rod 12 is connected to the small plunger 15. The lower end of the oil pipe 4 is connected to the Y-shaped three-way joint 10, and the small pump cylinder 11 is connected to the lower portion of the Y-shaped three-way joint 10. The small pump cylinder 11 is coaxial with the oil pipe. The other end of the Y-shaped thee-way joint 10 is provided with a submersible electric pump 16, and the electric submersible pump 16 is connected to the one-way valve 13 at the lower end. The lower end of the four-way connection 17 is connected to the hollow sucker rod 12, and the hollow sucker rod 12 extends to the bottom of the small pump cylinder 11.

As will be apparent to those skilled in the art in the light of the foregoing disclosure, many alterations and modifications are possible in the practice of this invention. The scope of the claims should not be limited by the preferred embodiments set forth in the examples, but should be given the broadest interpretation consistent with the description as a whole.

What is claimed is:

1. A device for heating oil and for reducing viscosity of the oil in an oil well, the device comprising: a pipe structure, a sucker rod, a three-way connector, a small pump cylinder, a small plunger, and a heating mechanism, wherein the three-way connector is located below the pipe structure and has an upper end and two lower ends, wherein the upper end of the three-way connector is connected to a bottom end of the pipe structure, and wherein the two lower ends of the three-way connector comprises a first lower end which is coaxial with the pipe structure and a second lower end which is non-coaxial with the pipe structure, and wherein the first lower end of the three-way connector is connected to the small pump cylinder which is coaxial with the pipe structure, and wherein the second lower end of the three-way connector comprises a bypass port and a check valve, and wherein the sucker rod extends inside the pipe structure and extends through the upper end and the first lower end of the three-way connector and extends to a bottom end of the small pump cylinder, and wherein a bottom end of the sucker rod is provided with the small plunger, and the small plunger and the small pump cylinder constitute an axial sliding sealed fit, and wherein the heating mechanism extends along the sucker rod to the bottom end of the sucker rod to provide heating to crude oil in the oil well, and wherein the sucker rod is hollow and the heating mechanism extends in a continuous and uninterrupted manner inside the hollow sucker rod to the bottom end of the sucker rod, and wherein the heating mechanism is capable of heating crude oil below the check valve and outside the device, and wherein a bottom end of the heating mechanism is at a position lower than a position of the check valve of the three-way connector.

2. The device according to claim 1, wherein the heating mechanism comprises a heating cable which generates heat.

3. The device according to claim 2, wherein a top end of the sucker rod is provided with a cable inlet, and wherein a top end of the heating cable extends at the cable inlet to a connecting cable which is connected to an electric controller.

4. The device according to claim 1, wherein an access port is provided at a top of the sucker rod and the heating mechanism enters the sucker rod through the access port.

5. The device according to claim 1, wherein the pipe structure comprises a tubing and a pump barrel connected to a bottom end of the tubing, and wherein the device comprises a plunger type oil pump, wherein the plunger type oil pump comprises a plunger which is located in the pump barrel and above the three-way connector, wherein the plunger comprises a plunger upper joint, a plunger barrel, and a valve seat, wherein the plunger barrel and the tubing form an axial sliding sealing fit, and wherein the plunger upper joint is fixedly connected to an upper end of the plunger barrel, and wherein the plunger upper joint has a conical upper part and the conical upper part of the plunger upper joint and the sucker rod form an axial sliding sealing fit, and the conical upper part of the plunger upper joint comprises one or more oil discharge holes or openings, and wherein the valve seat is annular and is connected to a bottom part of the plunger barrel, and wherein the device also comprises a valve sleeve which is fixedly connected to a portion of the sucker rod, and the valve sleeve and the valve seat can slidabley form a sealing fit.

6. The device according to claim 5, wherein the valve seat and the valve sleeve both have a tapered surface.

7. The device according to claim 6, wherein when the sucker rod descends, the check valve at the non-axial lower end of the three-way connector closes, and the valve seat and the valve sleeve separate, and when the sucker ascends, the check valve opens, and the valve seat and the valve sleeve from a seal, and such repeated up-and-down movements of the sucker rod enables crude oil to be lifted.

8. The device according to claim 1, wherein the heating mechanism comprises a heating circulation device, wherein the heating circulation device comprises a heating medium furnace for heating a heating medium, a circulation pump, and a circulation controller, wherein the circulation pump moves the heating medium to the bottom end of the sucker rod, and wherein the circulation controller controls the temperature and flow rate of the heating medium.

9. The device according to claim 8, wherein the sucker rod has a hollow interior, and the heating medium is flowed to the bottom end of the sucker rod through its interior.

10. The device according to claim 8, wherein the sucker rod is a double-channel hollow sucker rod comprising an outer tube and an inner tube, and the heating medium is flowed through the inner tube to the bottom end of the sucker rod and then returned via a space between the inner tube and the outer tube to the top end of the sucker rod and then back to the heating medium furnace to form a closed loop.

11. The device according to claim 1, wherein the device comprises an electrical submersible pump (ESP), wherein the electrical submersible pump is located at the bypass port of the three-way connector and above the check valve.

12. A device according to claim 1, wherein the pipe structure comprises a tubing and a pump barrel connected to a bottom end of the tubing, and wherein the device comprises a plunger type oil pump, wherein the plunger type oil pump comprises a plunger which is located in the pump barrel and above the three-way connector.

13. A device according to claim 1, wherein the heating mechanism has a length of 500 to 2000 meters or more than 2000 meters.

14. A method for heating oil and for reducing viscosity of the oil in an oil well, the method comprising: providing the device as defined in claim 1, placing the device in the oil well, and extending the heating mechanism along the sucker rod to the bottom end of the sucker rod to provide heating to crude oil in the oil well.

15. A method according to claim 14, wherein the heating mechanism comprises a heating cable which generates heat.

16. A method according to claim 15, wherein the heating cable extends for a length of 500 to 2000 meters or more below ground.

17. A method according to claim 14, wherein the heating mechanism comprises a heating medium which is pumped to the bottom end of the sucker rod.

18. A method according to claim 17, wherein the heating medium is returned from the bottom end of the sucker rod to the top end of the sucker rod and back to a heating medium furnace to form a closed loop.

19. A method according to claim 18, wherein the heating medium used is water.

20. A method according to claim 14, wherein the device heats the crude oil outside the device in the oil well before the crude oil even enters the device via the check valve.

* * * * *